US010034339B2

(12) United States Patent
Kim et al.

(10) Patent No.: US 10,034,339 B2
(45) Date of Patent: Jul. 24, 2018

(54) DEVICE FOR DRIVING LIGHT EMITTING DIODE, AND LIGHT EMITTING MODULE INCLUDING SAME

(71) Applicant: LG INNOTEK CO., LTD., Seoul (KR)

(72) Inventors: Min Hak Kim, Seoul (KR); Do Yub Kim, Seoul (KR); Jae Hun Yoon, Seoul (KR); Kwang Jae Lee, Seoul (KR); Seung Beom Jeong, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 0 days.

(21) Appl. No.: 15/548,905

(22) PCT Filed: Jan. 21, 2016

(86) PCT No.: PCT/KR2016/000656
§ 371 (c)(1),
(2) Date: Aug. 4, 2017

(87) PCT Pub. No.: WO2016/126030
PCT Pub. Date: Aug. 11, 2016

(65) Prior Publication Data

US 2018/0035497 A1 Feb. 1, 2018

(30) Foreign Application Priority Data

Feb. 6, 2015 (KR) ..... 10-2015-0018353

(51) Int. Cl.
*H05B 33/08* (2006.01)

(52) U.S. Cl.
CPC ..... *H05B 33/083* (2013.01); *H05B 33/089* (2013.01); *H05B 33/0809* (2013.01); *H05B 33/0827* (2013.01)

(58) Field of Classification Search
None
See application file for complete search history.

(56) References Cited

U.S. PATENT DOCUMENTS

2008/0094000 A1 4/2008 Yamamoto et al.
2013/0200802 A1 8/2013 Sakuragi et al.
(Continued)

FOREIGN PATENT DOCUMENTS

JP 2008-059811 A 3/2008
KR 1020110049434 * 5/2011 ..... H05B 37/02
(Continued)

*Primary Examiner* — Dedei K Hammond
(74) *Attorney, Agent, or Firm* — Birch, Stewart, Kolasch & Birch, LLP

(57) ABSTRACT

One embodiment relates to a device for driving a light emitting diode, the device controlling a plurality of light emitting diode arrays connected in series, and comprising: a rectifying unit for rectifying an alternating current signal so as to output the rectified signal; and a control unit for sensing the level of the rectified signal, comparing the sensed level of the rectified signal with a reference voltage, and aligning a first group among the plurality of light emitting diode arrays and a second group among the plurality of light emitting diode arrays in series or in parallel on the basis of the comparison result, wherein the control unit successively drives the light emitting diode arrays of the first and second groups connected in parallel or successively drives the light emitting diode arrays of the first and second groups connected in series on the basis of the magnitude of the sensed level of the rectified signal.

20 Claims, 5 Drawing Sheets

(56) References Cited

U.S. PATENT DOCUMENTS

| | | | |
|---|---|---|---|
| 2014/0175996 | A1 | 6/2014 | Yoon et al. |
| 2014/0197749 | A1 | 7/2014 | Yoon et al. |

FOREIGN PATENT DOCUMENTS

| | | | |
|---|---|---|---|
| KR | 10-2012-0069512 | A | 6/2012 |
| KR | 10-2013-0048949 | A | 5/2013 |
| KR | 10-2014-0081292 | A | 7/2014 |
| KR | 10-2014-0091254 | A | 7/2014 |
| KR | 10-2014-0100392 | A | 8/2014 |

* cited by examiner

DEVICE FOR DRIVING LIGHT EMITTING DIODE, AND LIGHT EMITTING MODULE INCLUDING SAME

CROSS REFERENCE TO RELATED APPLICATIONS

This application is the National Phase of PCT International Application No. PCT/KR2016/000656, filed on Jan. 21, 2016, which claims priority under 35 U.S.C. 119(a) to Patent Application No. 10-2015-0018353, filed in the Republic of Korea on Feb. 6, 2015, all of which are hereby expressly incorporated by reference into the present application.

TECHNICAL FIELD

Embodiments relate to a light-emitting element driving apparatus for driving a light-emitting element, and a light-emitting module including the same.

BACKGROUND ART

Thanks to advances in semiconductor technology, efficiency of light emitting diodes (LEDs) has remarkably improved. LEDs are environmentally friendly as well as economical because of longer lifespan and lower energy consumption than existing lighting devices such as incandescent lamps or fluorescent lamps. Due to these advantages, LEDs are attracting attention as a light source to replace traffic lights or backlights of flat panel display devices such as liquid crystal displays (LCDs).

When LEDs are used as lighting devices, the LEDs are connected in series or in parallel and are turned on and off by a light-emitting element control device. As such, the light-emitting element control device for controlling the LEDs generally rectifies an alternating current (AC) voltage and causes the LEDs to be turned on and off by the rectified ripple voltage.

DETAILED DESCRIPTION OF THE INVENTION

Technical Problem

Embodiments provide a light-emitting element driving apparatus capable of driving a light-emitting unit in a wide AC input voltage range, and a light-emitting module including the same.

Technical Solution

According to an embodiment, provided herein is a light-emitting element driving apparatus for controlling a plurality of serially connected light-emitting element arrays, including a rectifier configured to rectify an alternating current (AC) signal and output a rectified signal; and a controller configured to sense a level of the rectified signal, compare the sensed level of the rectified signal with a reference voltage, and connect a first group among the light-emitting element arrays to a second group among the light-emitting element arrays so as to be arranged in series or in parallel based on the result of comparison, wherein the controller sequentially drives light-emitting element arrays of the first and second groups connected in parallel or sequentially drives light-emitting element arrays of the first and second groups connected in series, based on the magnitude of the sensed level of the rectified signal.

If the level of the rectified signal is less than the reference voltage, the controller may connect at least one light-emitting element array belonging to the first group to at least one light-emitting element array belonging to the second group so as to be arranged in parallel, and if the level of the rectified signal exceeds the reference voltage, the controller may connect the light-emitting element arrays belonging to the first group to the light-emitting element arrays belonging to the second group so as to be arranged in series.

The first group may include serially connected light-emitting element arrays starting from a first light-emitting element array to a first node, the second group may include serially connected light-emitting element arrays starting from the first node to a last light-emitting element array, and the first node may be a connection point of any two adjacent light-emitting element arrays among the serially connected light-emitting element arrays.

The controller may include a changeover switch unit configured to connect an end of the rectifier to the first node and form a current path between the end of the rectifier and the first node, based on the result of comparison between the sensed level of the rectified signal and the reference voltage, and a switching unit including a plurality of switches, each of the switches being connected to an output terminal of any corresponding one among the serially connected light-emitting element arrays, and wherein the switches may be switched based on the magnitude of the sensed level of the rectified signal.

The controller may include an input voltage sensing unit configured to sense the level of the rectified signal and provide a sensing voltage according to the result of sensing, a control circuit configured to compare the sensing voltage with the reference voltage, generate a first control signal according to the result of comparison, and generate second control signals based on the level of the sensing voltage, a changeover switch unit configured to connect an end of the rectifier to the first node and perform a switching operation based on the first control signal, and a switching unit including a plurality of switches switched based on the second control signals, each of the switches being connected between an output terminal of any corresponding one among the serially connected light-emitting element arrays and the control circuit.

The changeover switch unit may include a first changeover switch configured to connect the one end of the rectifier to the first node, and a second changeover switch configured to provide the first changeover switch with a gate control voltage, supplied from the control circuit, for controlling an operation of the first changeover switch, based on the first control signal.

The changeover switch unit may further include a first resistor connected between a first drain and a first gate of the first changeover switch, and a second resistor connected between the first gate of the first changeover switch and the second changeover switch.

The changeover switch unit may further include a Zener diode connected between a first source and the first gate of the first changeover switch.

The changeover switch unit may further include a first diode connected between a cathode of a last light-emitting element array among the light-emitting element arrays of the first group and the first node.

The changeover switch unit may further include a second diode connected between the first changeover switch and the first node.

The controller may further include a protection unit including a first capacitor connected between a second node and the other end of the rectifier, and the second node may be a node at which the last light-emitting element array of the serially connected light-emitting element arrays and a switch corresponding to the last light-emitting element array among the switches are connected.

The protection unit may further include a second capacitor connected between a third node and the other end of the rectifier, and the third node may be a node at which a light-emitting element array immediately prior to the last light-emitting element array and a switch corresponding to the light-emitting element array immediately prior to the last light-emitting element array are connected.

The protection unit may further include a transistor having a source and a drain connected between the third node and the other end of the rectifier and a gate controlled by the control circuit.

The number of the light-emitting element arrays of the first group may be equal to the number of the light-emitting element arrays of the second group.

According to another embodiment, a light-emitting element driving apparatus for controlling a plurality of serially connected light-emitting element arrays includes a rectifier configured to rectify an alternating current (AC) signal and output a rectified signal; an input voltage sensing unit configured to sense a level of the rectified signal and provide a sensing voltage according to the result of sensing; a control circuit configured to generate a first control signal according to a result of comparing the sensing voltage with a reference voltage and generate second control signals based on a level of the sensing voltage; a changeover switch unit configured to connect between an end of the rectifier and a first node and switched based on the first control signal; and a plurality of switches configured to perform a switching operation based on the second control signals, wherein each of the switches is connected to any corresponding one among output terminals of the serially connected light-emitting element arrays, and the first node is a connection point of any two adjacent light-emitting element arrays among the serially connected light-emitting element arrays.

The plural light-emitting element arrays may include a first group including serially connected light-emitting element arrays starting from a first light-emitting element array to the first node and a second group including serially connected light-emitting element arrays starting from the first node to a last light-emitting element array, and at least one of the light-emitting element arrays belonging to the first group may be connected to at least one of the light-emitting element array belonging to the second group in series or in parallel by switching of the changeover switch unit and switching of the plural switches.

The changeover switch unit may electrically connect an end of the rectifier to the first node to form a current path between the end of the rectifier and the first node, when the level of the rectified signal is less than the reference voltage.

The changeover switch unit may electrically disconnect the end of the rectifier from the first node to cut off a current path between the end of the rectifier and the first node, when the level of the rectified signal exceeds the reference voltage.

The reference voltage may be equal to or greater than the sum of driving voltages of the light-emitting element arrays of the first group and a driving voltage of any one of the light-emitting element arrays of the second group.

According to an embodiment, a light-emitting module includes a light-emitting unit including a plurality of serially connected light-emitting element arrays, and the light-emitting element driving apparatus according to embodiments.

Advantageous Effects

Embodiments can drive a light-emitting unit in a wide AC input voltage range.

BEST MODE FOR CARRYING OUT THE INVENTION

Hereinafter, embodiments will be clearly appreciated through the accompanying drawings and the following description thereof. In the description of the embodiments, it will be understood that, when an element such as a layer (or film), region, pattern, or structure is referred to as being formed "on" or "under" another element, such as a substrate, layer (or film), region, pad, or pattern, it can be directly "on" or "under" the other element or be indirectly formed with intervening elements therebetween. It will also be understood that "on" or "under" the element may be described relative to the drawings. The same reference number is used to designate the same element throughput the drawings.

Figure 1:
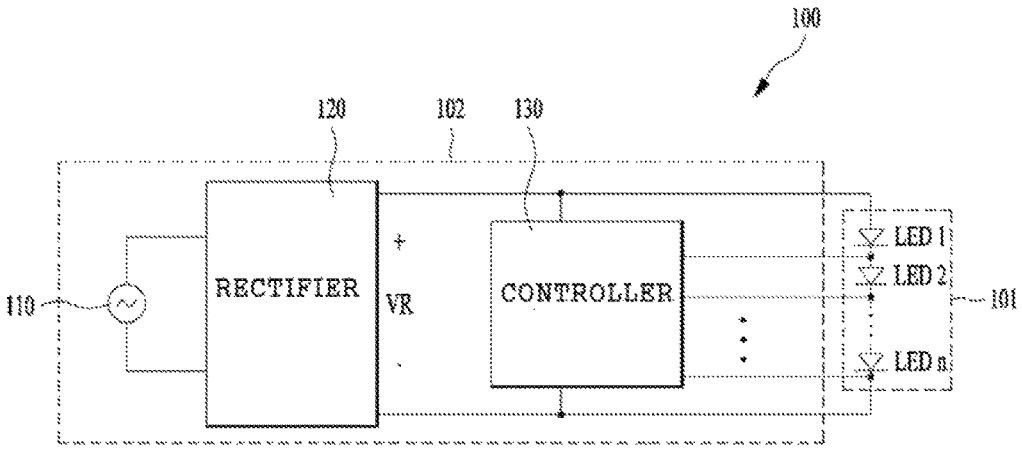
FIG. 1 is a schematic block diagram of a light-emitting module 100 according to an embodiment.

FIG. 1 is a schematic block diagram of a light-emitting module 100 according to an embodiment.

Referring to FIG. 1, the light-emitting module 100 includes a light-emitting unit 101 for emitting light and a light-emitting element driver 102 for driving and controlling the light-emitting unit 101.

The light-emitting unit 101 includes a plurality of light-emitting element arrays LED1 to LEDn (where n is a natural number greater than 1) connected in series.

Figure 4:
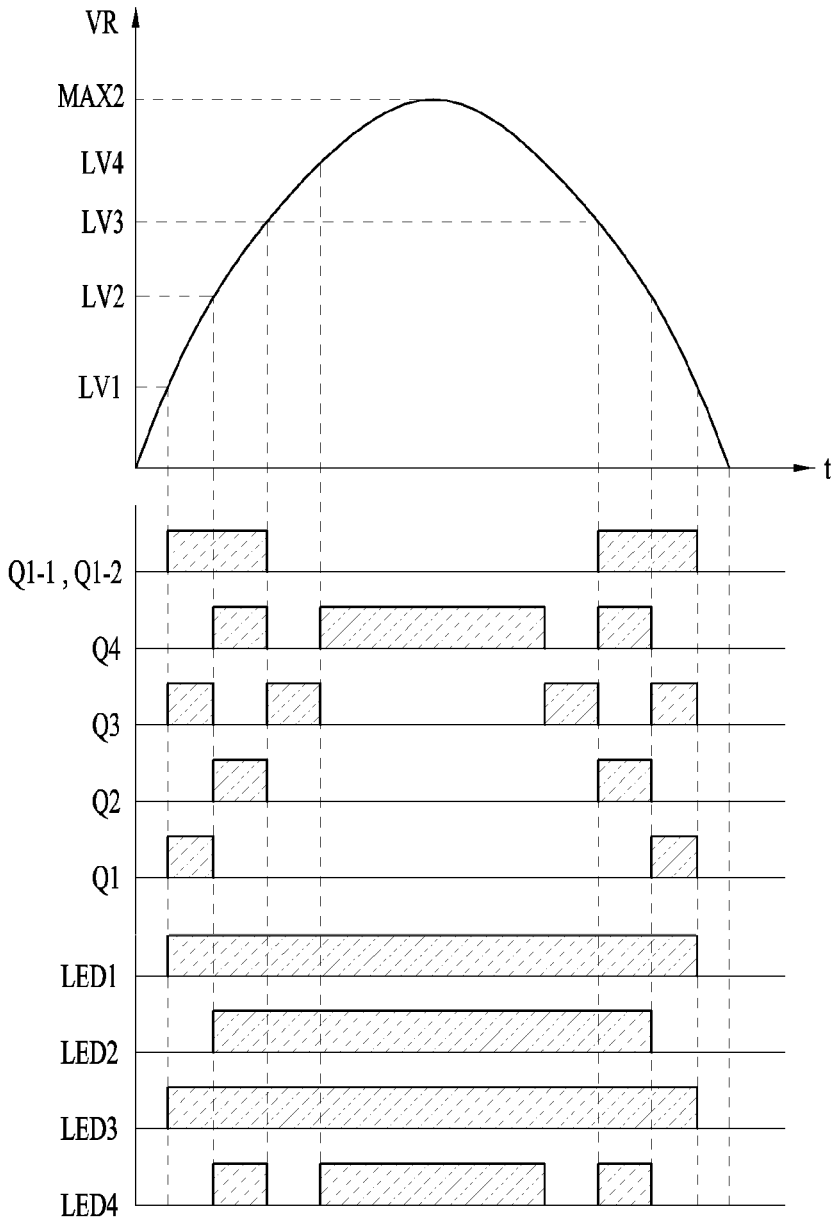
FIG. 4 illustrates an operation of a light-emitting element driver when the maximum level of a rectified signal exceeds a reference voltage.

For example, the light-emitting unit 101 may include first to n-th light-emitting element arrays LED1 to LEDn (where n is a natural number greater than 1) which are sequentially connected in series. In FIG. 4, n is equal to 4 but is not limited thereto.

Each of the light-emitting element arrays LED1 to LEDn (where n is a natural number greater than 1) may include one or more light-emitting elements, e.g., one or more light-emitting diodes.

If a plurality of light-emitting elements is included in a light-emitting element array, the light-emitting elements may be connected in series, may be connected in parallel, or may be connected in series and in parallel.

The light-emitting element driver 102 controls light emission of the light-emitting element arrays LED1 to LEDn (where n is a natural number greater than 1) connected in series.

The light-emitting element driver 102 may include an AC power source 110, a rectifier 120, and a controller 130.

The AC power source 110 provides an AC signal Vac to the rectifier 120.

Figure 6A:
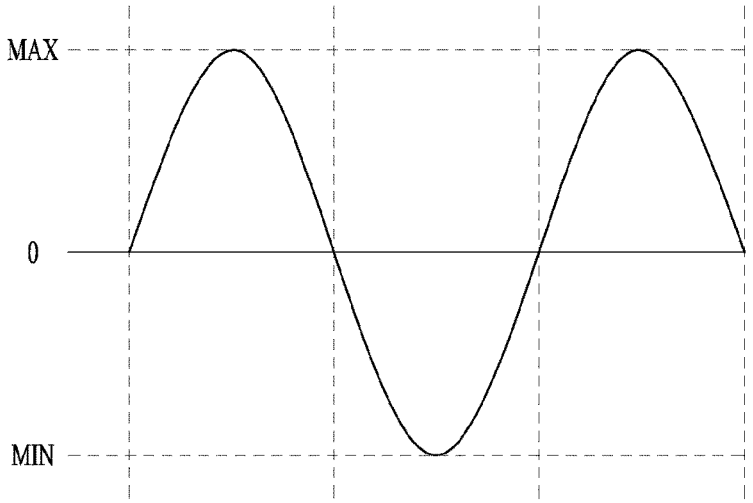
FIG. 6*a* is a waveform chart of an AC signal supplied from an AC power source shown in FIG. 1.

FIG. 6*a* is a waveform chart of the AC signal Vac supplied from the AC power source 110 shown in FIG. 1.

Referring to FIG. 6*a*, the AC signal Vac may be a sine wave or a cosine wave having a maximum value MAX and a minimum value MIN. However, the AC signal Vac is not limited to such a wave. For example, the AC signal Vac may be, without being limited to, an AC voltage having a maximum value of about 100 to 220 V and a frequency of 50 to 60 Hz.

The rectifier 120 rectifies the AC signal Vac supplied from the AC power source 110 and outputs a rectified signal VR which is ripple current generated as a result of rectification.

Figure 6B:
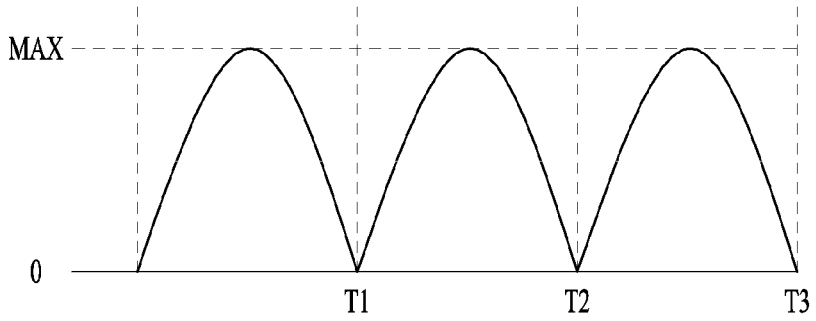
FIG. 6*b* illustrates a rectified signal output by a rectifier shown in FIG. 1.

FIG. 6*b* illustrates the rectified signal VR generated from the rectifier 120 shown in FIG. 1. Referring to FIG. 6*b*, the rectifier 120 may full wave-rectify the AC signal Vac shown in FIG. 6*a* and output the rectified signal VR as shown in FIG. 6*b*. For example, the rectified signal VR may be a full wave-rectified AC voltage.

The controller 130 controls lighting on and off of the light-emitting element arrays LED1 to LEDn (where n is a natural number greater than 1) of the light-emitting unit 101, based on the level of the rectified signal VR supplied from the rectifier 120.

For example, if the level of the rectified signal VR is equal to or less than a reference voltage Vref (i.e., VRVref), the controller 130 may connect the light-emitting element arrays (e.g., LED1 and LED2) of a first group to the light-emitting element arrays (e.g., LED3 and LED4) of a second group so as to be arranged in parallel and sequentially drive the light-emitting element arrays of the first and second groups, which are connected in parallel, based on the level of the rectified signal VR. For example, the reference voltage Vref may be set based on the number of light-emitting element arrays and the operating voltage of light-emitting element arrays. For example, the reference voltage Vref may be, without being limited to, 160 V.

The first group may include serially connected light-emitting element arrays starting from the first light-emitting element array (e.g., LED1) to a first node N1. The second group may include serially connected light-emitting element arrays starting from the first node N1 to the last light-emitting element array (e.g., LEDn where n=4). The first node N1 may be a connection point of any two adjacent light-emitting element arrays among serially connected light-emitting element arrays.

For example, the number of light-emitting element arrays of the first group may be equal to that of the second group but they may be different.

In addition, for example, if the level of the rectified signal VR exceeds the reference voltage Vref (i.e., VR>Vref), the controller 130 may sequentially drive the first to n-th light-emitting element arrays based on the level of the rectified signal VR.

The light-emitting element driver 102 may further include a fuse between the AC power source 110 and the rectifier 120. The fuse serves to protect the light-emitting element driver 102 from an AC signal having an instantaneously high level. That is, if the AC signal having an instantaneously high level is provided, the fuse is disconnected to protect the light-emitting element driver 102 from the AC signal having a high level.

Figure 2:
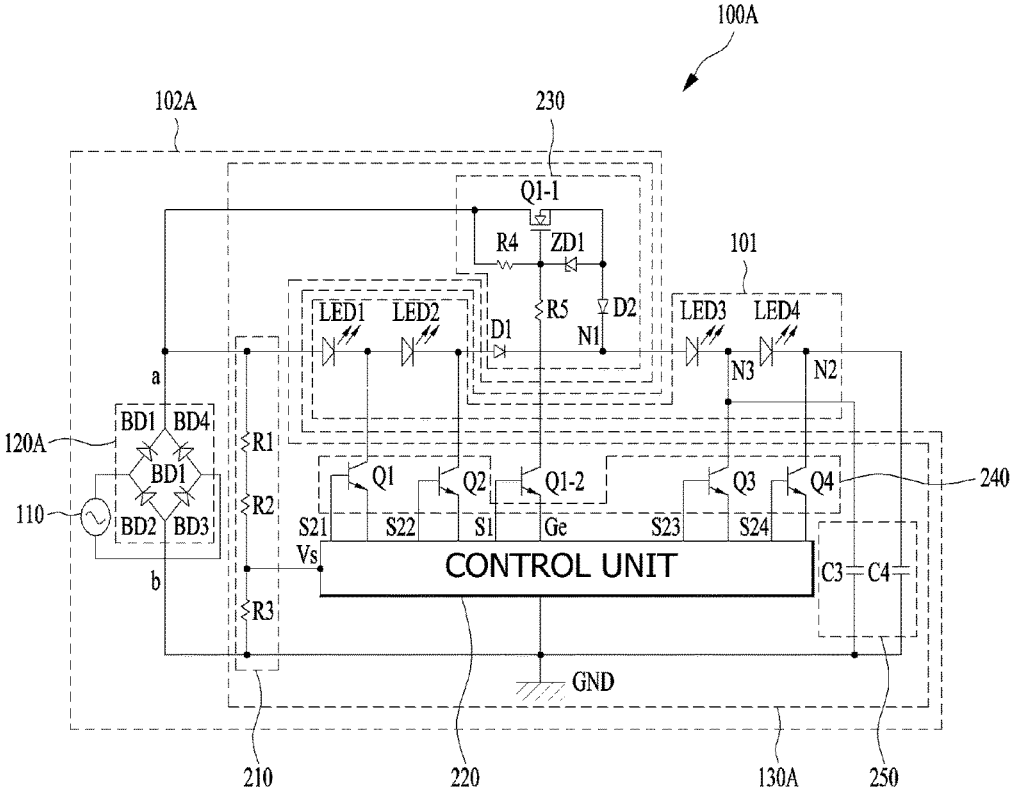
FIG. 2 is a diagram illustrating the configuration of a light-emitting module including a light-emitting element driver according to an embodiment.

FIG. 2 is a diagram illustrating the configuration of a light-emitting module 100A including a light-emitting element driver 102A according to an embodiment. The same reference numerals as in FIG. 1 indicate the same constructions and therefore a description of the same constructions is omitted or is briefly given.

Referring to FIG. 2, the light-emitting module 100A may include a light-emitting unit 101 and the light-emitting element driver 102A. The light-emitting element driver 102A may include the AC power source 110, a rectifier 120A, and a controller 130A.

The rectifier 120A may be implemented by a full wave diode bridge circuit including four diodes BD1, BD2, BD3, and BD4. The rectifier 120A may output a rectified signal VR through both ends thereof a and b. One end a of the rectifier 120A may be connected to an anode of the first light-emitting element array LED1 among serially connected light-emitting element arrays. The other end b of the rectifier 120A may be electrically connected to a cathode of the last light-emitting element array LEDn among the serially connected light-emitting element arrays.

The controller 130A may include an input voltage sensing unit 210, a control circuit 220, a changeover switch unit 230, a switching unit 240, and a protection unit 250.

The input voltage sensing unit 210 senses the level of the rectified signal VR supplied from the rectifier 120A and provides a sensing voltage Vs based on the result of the sensing to the control circuit 220.

For example, the input voltage sensing unit 210 may be implemented in the form of a voltage distributor including resistors, for example, R1 to R3, serially connected to both ends a and b of the rectifier 120A and supply a voltage across at least one of the serially connected resistors to the control circuit 220 as the sensing voltage Vs.

The control circuit 220 may generate a first control signal S1 for controlling the changeover switch unit 230, and second control signals S21 to S2*n* (where n is a natural number greater than 1) for controlling the switching unit 240, based on the sensing voltage Vs supplied from the input voltage sensing unit 210.

For example, the control circuit 220 may compare the sensing voltage Vs with the reference voltage Vref and generate the first control signal S1 according to the result of comparison. For example, the reference voltage Vref may be determined according to an operating voltage Vf of the light-emitting unit 101 and the number of light-emitting element arrays included in the light-emitting unit 101. For example, the reference voltage may be, without being limited to, 160 V.

In addition, for example, the control circuit 220 may generate the second control signals S21 to S2*n* (where n is a natural number greater than 1) based on the level of the sensing voltage Vs.

The changeover switch unit 230 connects light-emitting element arrays of a first group, e.g., LED1 and LED2, to light-emitting element arrays of a second group, e.g., LED3 and LED4, in serial or in parallel, according to the result of comparing the rectified signal VR with the reference voltage Vref.

For example, the changeover switch unit 230 may connect one end a of the rectifier 120A to a first node N1 and connect the light-emitting element arrays of the first group (e.g., LED1 and LED2) to the light-emitting element arrays of the second group (e.g., LED3 and LED4) in serial or in parallel, based on the first control signal S1 provided by the control circuit 220. The rectified signal VR may be generated from the end a of the rectifier 120A.

For example, when the level of the rectified signal VR is less than the reference voltage Vref, the changeover switch unit 230 may electrically connect the end a of the rectifier 120A to the first node N1 so as to form a current path between the end a of the rectifier 120A and the first node N1.

For example, when the level of the rectified signal VR exceeds the reference voltage Vref, the changeover switch unit 230 may disconnect the end a of the rectifier 120A from the first node N1 so as to cut off the current path between the end a of the rectifier 120A and the first node N1.

The changeover switch unit 230 may include a first changeover switch Q1-1 connecting the end a of the rectifier 120A to the first node N1, and a second changeover switch Q1-2 for providing the first changeover switch Q1-1 with a gate control voltage Ge, supplied from the control circuit 220, for controlling an operation of the first changeover switch Q1-1, based on the first control signal S1.

The first changeover switch Q1-1 may include a first gate, and a first source and a first drain connected respectively to the end a of the rectifier 120A and the first node N1.

The second changeover switch Q1-2 may include a second gate to which the first control signal S1 is applied, and a second source and a second drain connected respectively to the first gate of the first changeover switch Q1-1 and the control circuit 220.

The second changeover switch Q1-2 may provide the gate control voltage Ge supplied from the control circuit 220 to the first gate of the first changeover switch Q1-1, in response to the first control signal S1.

That is, turning-on or turning-off of the first changeover switch Q1-1 may be determined in response to the first control signal S1 and the current path between the end a of the rectifier 120A and the first node N1 may be formed or cut off in response to the first control signal S1.

The first and second changeover switches Q1-1 and Q1-2 may be implemented by transistors, e.g., field effect transistors (FETs) or bipolar junction transistors (BJTs). However, an embodiment is not limited thereto. For example, the first changeover switch Q1-1 and the second changeover switch Q1-2 may be, without being limited to, an FET and a BJT, respectively.

The changeover switch unit 230 may further include a resistor R4 connected between the first drain and the first gate of the first changeover switch Q1-1 and a resistor R5 connected between the first gate of the first changeover switch Q1-1 and the second changeover switch Q1-2.

The resistors R3 and R4 may be biased so that the first changeover switch Q1-1 may be turned on. For example, if the second changeover switch Q1-2 is turned on, the gate voltage of the first changeover switch Q1-1 may be maintained at a voltage less than an operating voltage and current may flow into the second changeover switch Q1-2 through resistors R4 and R5, thereby preventing excessive current from flowing into a collector of the second changeover switch Q1-2.

In addition, the changeover switch unit 230 may further include a Zener diode ZD1 connected between the first source and the first gate of the first changeover switch Q1-1. The Zener diode ZD1 may be connected in a forward direction from the first source to the first gate of the first changeover switch Q1-1.

If the second changeover switch Q1-2 is turned off, the Zener diode ZD1 may stabilize the gate voltage of the first changeover switch Q1-1 so that a uniform voltage is applied to the gate of the first changeover switch Q1-1.

In addition, the changeover switch unit 230 may further include a first diode connected between a cathode of the last light-emitting element array (e.g., LED2) among the light-emitting element arrays of the first group and the first node N1. The first diode D1 may be connected in a forward direction from the cathode of the last light-emitting element array (e.g., LED2) among the last light-emitting element arrays of the first group to the first node N1.

If the first changeover switch Q1-1 is turned on and thus the first group and the second group are connected in parallel, the first diode D1 may serve to prevent current flowing into the first changeover switch Q1-1 from flowing from the first node N1 into a second switch Q2.

The changeover switch unit 230 may further include a second diode D2 connected between the first source of the first changeover switch Q1-1 and the first node N1. The second diode D2 may be connected in a forward direction from the first source of the first changeover switch Q1-1 to the first node N1.

If the first changeover switch Q1-1 is turned off and thus the first group and the second group are connected to series, the second diode D2 may serve to prevent current flowing from the second light-emitting element array LED2 of the first group into the first node N1 from flowing through the Zener diode ZD1, the resistor R5, and the second changeover switch Q1-2.

The switching unit 240 includes a plurality of switches Q1 to Qn (where n is a natural number greater than 1). Each of the switches Q1 to Qn (where n is a natural number greater than 1) may be connected to an output terminal (e.g., a cathode) of any corresponding one among a plurality of serially connected light-emitting element arrays LED1 to LEDn (where n is a natural number greater than 1).

Each of the switches Q1 to Qn (where n is a natural number greater than 1) may be switched in response to any corresponding one of the second control signals S21 to S2*n* (where n is a natural number greater than 1).

For example, each of the switches Q1 to Qn (where n is a natural number greater than 1) may be implemented by a BJT and may has an emitter and a collector connected respectively to an output terminal (e.g., a cathode) of any corresponding one of the light-emitting element arrays LED1 to LEDn and the second circuit 220 and a base to which a corresponding one of the second control signal S21 to S2*n* is input. According to another embodiment, each of the switches Q1 to Qn may be implemented by an FET. In this case, the second control signal may be input to a gate of the FET.

At least one of the light-emitting element arrays of the first group and at least one of the light-emitting element arrays of the second group may be connected in series or in parallel, by switching of the changeover switch unit 230 and switching of the switches Q1 to Q4 of the switching unit 240.

The protection unit 250 serves as a buffer for a surge voltage when the rectified signal VR includes the surge voltage, thereby protecting the switches Q3 and Q4 of the switching unit 240.

The protection unit 250 may include at least one capacitor connected between at least one of connection points at which the switches Q21 to Q2*n* (where n is a natural number greater than 1) of the switching unit 240 and the light-emitting element arrays LED1 to LEDn (where n is a natural number greater than 1) are connected and the other end b of the rectifier 120A.

For example, the protection unit 250 may include a first capacitor C4 connected between the second node N2 and the other end b of the rectifier 120A and a second capacitor C3 connected between the third node N3 and the other end b of the rectifier 120A.

The second node N2 may be a node at which an output terminal of the last light-emitting element array (e.g., LED4) and a switch (e.g., Q4) corresponding to the last light-emitting element array (e.g., LED4) among the switches are connected.

A third node N3 may be a node at which an output terminal of a light-emitting element array (e.g., LED3) immediately prior to the last light-emitting element array (e.g., LED4) and a switch (e.g., Q3) corresponding to the light-emitting element array LED3 are connected.

If the level of the rectified voltage VR is above the sum of total operating voltages of the light-emitting element arrays LED1 to LEDn (where n is a natural number greater than 1) due to inflow of the surge voltage, a high voltage is applied to the third and fourth switches Q3 and Q4 and thus power consumed in the third and fourth switches Q3 and Q4 increases, thereby generating excessive heat.

If the level of the rectified voltage VR increases due to inflow of the surge voltage, voltages across third and fourth switches Q3 and Q4 may be lowered by the first and second capacitors C3 and C4 of the protection unit 250. Therefore, the third and fourth switches Q3 and Q4 can be prevented from generating excessive heat. This is because the surge voltage is distributed across the first and second capacitors C3 and C4 and thus the voltages across the third and fourth switches Q3 and Q4 are lowered.

Figure 3:
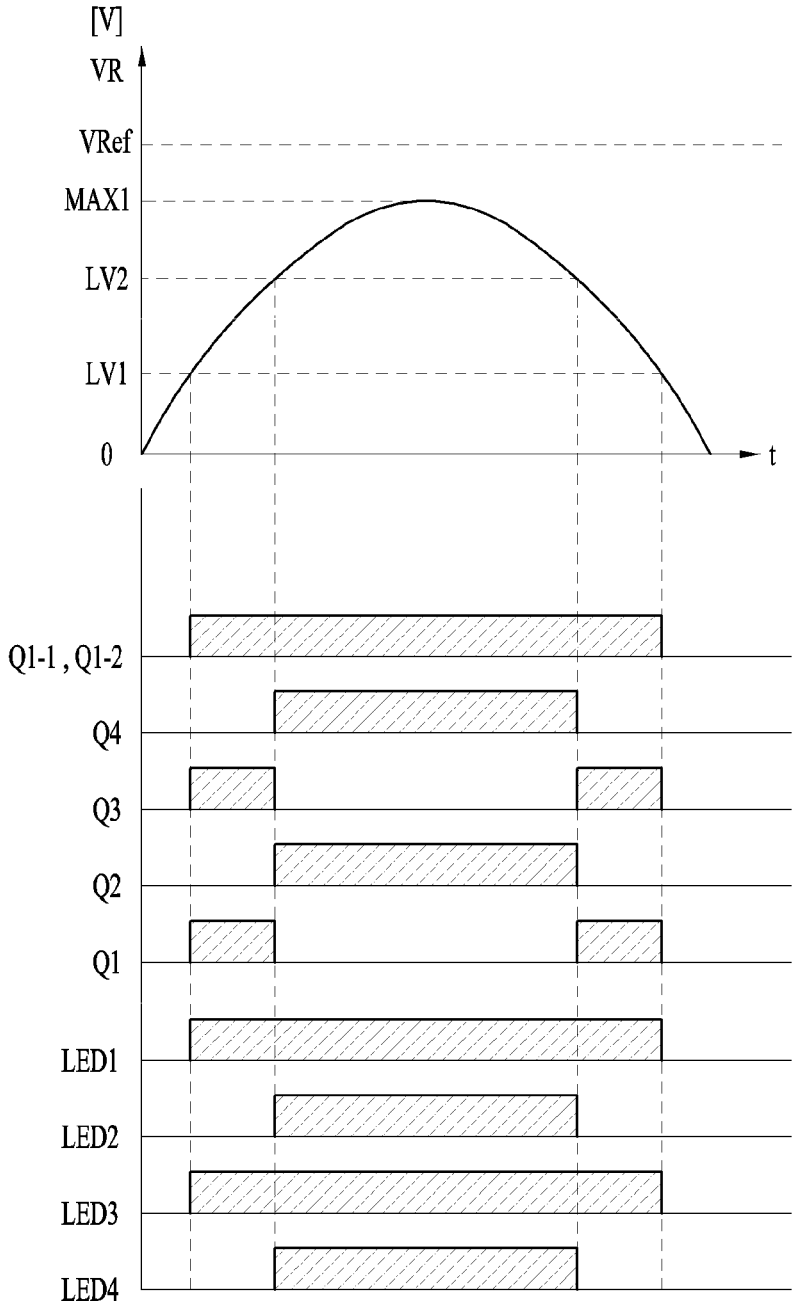
FIG. 3 illustrates an operation of a light-emitting element driver when the level of a rectified signal is less than a reference voltage.

FIG. 3 illustrates an operation of the light-emitting element driver 102A when the level of the rectified signal VR is less than the reference voltage Vref.

Referring to FIG. 3, the control circuit 220 may sense the level of the rectified voltage VR, based on the sensing voltage Vs provided by the input voltage sensing unit 210.

If the sensed level of the rectified voltage VR is less than the reference voltage Vref, the first changeover switch Q1-1 of the changeover switch unit 230 may be turned on in response to the first control signal S1 and the light-emitting element arrays (e.g., LED1 and LED2) of the first group and the light-emitting element arrays (e.g., LED3 and LED4) of the second group may be connected in parallel.

In a duration during which the sensed level of the rectified voltage VR is less than a first voltage level LV1 (VR<LV1), all of the first to fourth switches (e.g., Q1 to Q4) may be turned off by the second control signals (e.g., S21 to S24) and all of the light-emitting element arrays (e.g., LED1 and LED2, and LED3 and LED4 of the first and second groups which are connected in parallel may be turned off.

In a duration in which the sensed level of the rectified voltage VR is greater than the first voltage level LV1 and less than a second voltage level LV2 (i.e., LV1≤VR<LV2), the first and third switches (e.g., Q1 and Q3) may be turned on and the second and fourth switches (e.g., Q2 and Q4) may be turned off, by the second control signals (e.g., S21 to S24), any one of the light-emitting element array of the first group and any one of the light-emitting element array of the second group may be connected in parallel, and the light-emitting element arrays of the first and second groups connected in parallel may be turned on.

For example, the first light-emitting element array (e.g., LED1) of the first group and the third light-emitting element array (e.g., LED3) of the second group may be connected in parallel and the first and third light-emitting element arrays (e.g., LED1 and LED3) connected in parallel may be turned on.

In a duration in which the sensed level of the rectified voltage VR is greater than the second voltage level LV2 and less than a first maximum level MAX1 (LV2≤VR<MAX1), the second and fourth switches Q2 and Q4 may be turned on and the first and third switches Q1 and Q3 may be turned off, by the second control signals (e.g., S21 to S24). In addition, the light-emitting element arrays (e.g., LED1 and LED2) of the first group and the light-emitting element arrays (e.g., LED3 and LED4) of the second group may be connected in parallel and the light-emitting element arrays (e.g., LED1 and LED2, and LED3 and LED4) of the first and second groups connected in parallel may be turned on.

Each of the voltage levels LV1 and LV2 may be voltages capable of driving the first and second groups connected in parallel.

For example, the first voltage level LV1 may be a voltage capable of driving the first and second light-emitting element arrays (e.g., LED1 and LED2) in the first and second groups connected in parallel. For example, the first voltage level LV1 may be an operating voltage of the first light-emitting element array or the second light-emitting element array.

The second voltage level LV2 may be a voltage capable of driving the first to fourth light-emitting element arrays LED1 and LED2, and LED3 and LED4 connected in parallel. For example, the second voltage level LV2 may be a voltage level of the sum of operating voltages of the first and second light-emitting element arrays or a voltage level of the sum of operating voltages of the third and fourth light-emitting element arrays.

The first maximum level MAX1 may be less than or equal to the reference voltage Vref.

FIG. 4 illustrates an operation of the light-emitting element driver 102A when a maximum level of the rectified signal VR exceeds the reference voltage Vref.

As described with reference to FIG. 3, while the level of the rectified voltage VR is less than the reference voltage Vref, the light-emitting element arrays (e.g., LED1 and LED2) of the first group and the light-emitting element arrays (e.g., LED3 and LED4) of the second group may be connected in parallel, by the control circuit 220.

In a duration during which the sensed level of the rectified voltage VR is less than the first voltage level LV1 (VR<LV1), in a duration during which the sensed level of the rectified voltage VR is greater than the first voltage level LV1 and less than the second voltage level LV2 (LV1≤VR<LV2), and in a duration during which the sensed level of the rectified voltage VR is greater than the second voltage level LV2 and less than the first maximum level MAX1 (LV2≤VR<MAX1), the light-emitting element arrays (e.g., LED3 and LED4) may be turned on or off, in a state in which at least one of the light-emitting element arrays of the first group and at least one of the light-emitting element arrays of the second group are connected in parallel, as described with reference to FIG. 3.

Next, if the sensed level of the rectified voltage VR exceeds the reference voltage Vref, the first changeover switch Q1-1 of the changeover switch unit 230 may be turned off in response to the first control signal S1 and the light-emitting element arrays (e.g., LED1 and LED2) of the first group and the light-emitting element arrays (e.g., LED3 and LED4) of the second group may be connected in series. That is, the first to fourth light-emitting element arrays (e.g., LED1 to LED4) may be serially connected.

In a duration during which the sensed level of the rectified voltage VR is greater than a third voltage level LV3 and less than a fourth voltage level LV4 (LV3≤VR<LV4) in a state in which the first group and second group are serially connected, the third switch (e.g., Q3) may be turned on, the first, second, and fourth switches (e.g., Q1, Q2, and Q4) may be turned off, the first to third light-emitting element arrays (e.g., LED1 to LED3) may be turned on, and the fourth light-emitting element array (e.g., LED4) may be turned off, by the second control signals (e.g., S21 to S24).

In a duration during which the sensed level of the rectified voltage VR is greater than the fourth voltage level LV4 and less than a preset second maximum level MAX2 (LV4≤VR<MAX2) in a state in which the first group and the second group are serially connected, the fourth switch (e.g., Q4) may be turned on, the first to third switches (e.g., Q1 to Q3) may be turned off, and the first to fourth light-emitting element arrays LED1 to LED4 may be turned on, by the second control signals (e.g., S21 to S24).

The third voltage level LV3 may be a voltage capable of driving the serially connected first to third light-emitting element arrays (e.g., LED1 to LED3). For example, the third voltage level LV3 may be a voltage level of the sum of operating voltages of the first to third light-emitting element arrays.

The third voltage level LV3 may be greater than or equal to the first maximum level MAX1.

The reference voltage Vref may be greater than the sum of driving voltages of the light-emitting element arrays of the first group. For example, the reference voltage Vref may be equal to or greater than the sum of driving voltages of the light-emitting element arrays of the first group and a driving voltage of any one light-emitting element array of the second group. For example, the reference voltage Vref may be less than the sum of driving voltages of the light-emitting element arrays of the first group and driving voltages of any two light-emitting element arrays of the second group.

The fourth voltage level LV4 may be a voltage capable of driving the first to fourth light-emitting element arrays (e.g., LED1 to LED4) connected in series. For example, the fourth voltage level LV4 may be a voltage level of the sum of the driving voltages of the first to fourth light-emitting element arrays (e.g., LED1 to LED4).

A light-emitting element driving apparatus of a normal AC direct scheme may have an input voltage region of 200 to 240 V when an input AC voltage is 220 V and 100 to 120 V when the input AC voltage is 110 V. This input voltage region may be narrow as compared with a switched-mode power supply (SMPS) scheme having an input voltage region of 90 to 140 V and 180 to 264 V.

If an AC voltage of 110 V is supplied to a light-emitting element driving apparatus for driving a light-emitting unit having a driving voltage of 220 V, current flowing into the light-emitting unit is halved.

According to an embodiment, even when the level of an input AC voltage varies (e.g., from 110 to 220 V), reduction of current flowing into the light-emitting unit 101 is prevented and the light-emitting unit 101 can be driven with the same brightness.

According to an embodiment, the range of the AC input voltage can be expanded, the light-emitting element driving apparatus may be used in a region in which the input AC voltage is 100, 120, or 230 V, and two or three products (e.g., light-emitting modules including light-emitting element arrays) having different AC input voltage regions may be replaced with one product having one AC input voltage region.

Figure 5:
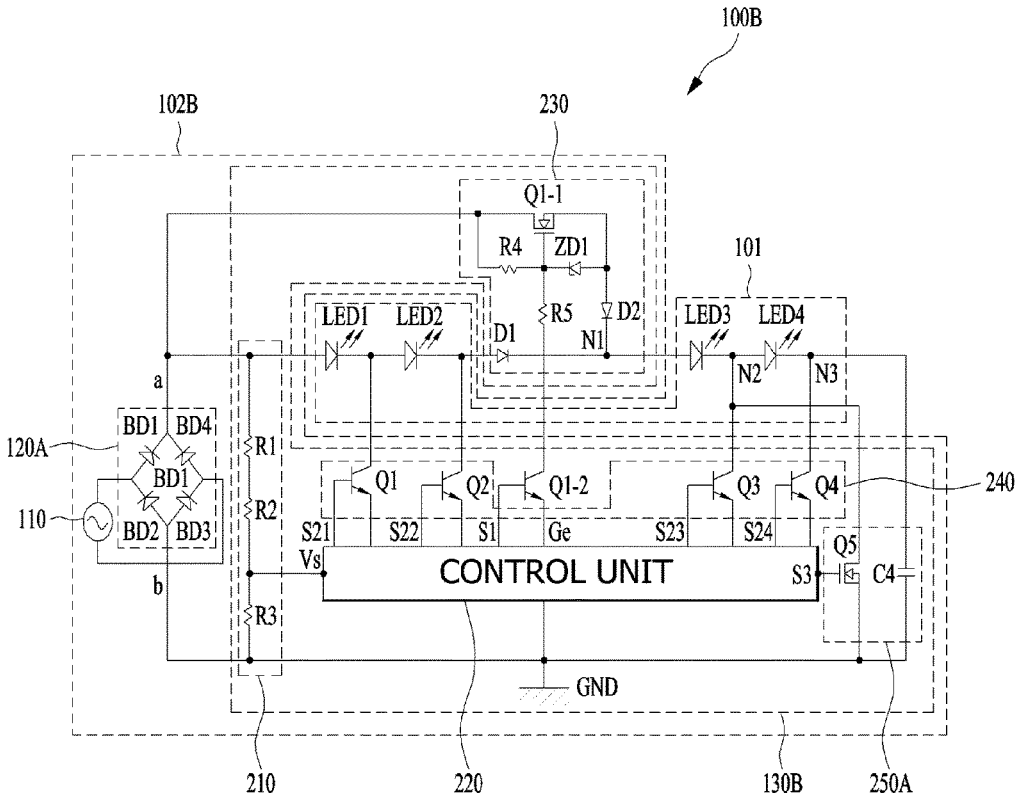
FIG. 5 is a diagram illustrating the configuration of a light-emitting module including a light-emitting element driver according to another embodiment.

FIG. 5 is a diagram illustrating the configuration of a light-emitting module 100B including a light-emitting element driver 102B according to another embodiment. The same reference numerals as in FIG. 2 indicate the same constructions and therefore a description of the same constructions is briefly given or is omitted.

Referring to FIG. 5, the light-emitting module 100B may include a light-emitting unit 101, and the light-emitting element driver 102B for driving the light-emitting unit 101.

The light-emitting element driver 102B may include an AC power source 110, a rectifier 120A, and a controller 130B.

The controller 130B may include an input voltage sensing unit 210, a control circuit 220, a changeover switch unit 230, a switching unit 240, and a protection unit 250A.

The second capacitor C3 of the protection unit 250 shown in FIG. 2 may be replaced with a transistor Q5 of the protection unit 250A in FIG. 5. The transistor Q5 may be, without being limited to, an FET.

The transistor Q5 is connected between a node N2 and the other end b of the rectifier 120A and is switched in response to a third control signal S3 provided by the control circuit 220.

For example, the transistor Q5 may include a source and a drain connected respectively to the node N2 and the other end b of the rectifier 120A and a gate to which the third control signal S3 is input.

The third control signal S3 may be generated based on the level of a sensing voltage Vs. For example, since the level of a rectified signal VR when a surge voltage is applied is greater than a second maximum level MAX2, the control circuit 220 may generate the control signal S3 for turning on the transistor Q5 when the level of the rectified signal VR determined based on the level of the sensing voltage Vs exceeds the second maximum voltage MAX.

When the surge voltage is supplied, the control circuit 220 turns on the FET Q5, so that a part of the surge voltage having a high voltage and a high frequency, corresponding to a breakdown voltage of the FET Q5, for example, the maximum value of a source-drain voltage of the FET Q5, may be distributed to the FET Q5. Then, a voltage across the switch Q3 can be lowered and the switch Q3 can be prevented from generating excessive heat.

The protection circuit 250 shown in FIG. 2 may be used when the surge voltage ranges from 500 V to 1 kV and the protection circuit 250A shown in FIG. 5 may be used when the surge voltage is greater than 1 kV.

As described above, the embodiment drives the light-emitting element arrays of the first and second groups to be connected in parallel when the level of the rectified signal VR is less than the reference voltage Vref and drives the light-emitting element arrays of the first and second groups to be connected in series when the level of the rectified signal VR exceeds the reference voltage Vref, thereby driving the light-emitting unit 101 in a wide AC input voltage range, for example, 100 to 230 V.

Features, structures, effects, and the like as described hereinabove in the embodiments are included in at least one embodiment of the present invention and should not be limited to only one embodiment. In addition, the features, structures, effects, and the like described in the respective embodiments may be combined or modified even with respect to the other embodiments by those skilled in the art. Accordingly, contents related to these combinations and modifications should be construed as within the scope of the present invention.

INDUSTRIAL APPLICABILITY

The embodiments are applied to a light-emitting element driving apparatus and a lighting device, capable of driving a light-emitting unit in a wide AC input voltage range.

The invention claimed is:

1. A light-emitting element driving apparatus for controlling a plurality of serially connected light-emitting element arrays, comprising:

a rectifier configured to rectify an alternating current (AC) signal and output a rectified signal; and a controller configured to sense a level of the rectified signal, compare the sensed level of the rectified signal with a reference voltage, and connect a first group among the light-emitting element arrays to a second group among the light-emitting element arrays so as to be arranged in series or in parallel based on a result of comparison, wherein the first group includes serially connected light-emitting element arrays starting from a first light-emitting element array to a first node, and the second group includes serially connected light-emitting element arrays starting from the first node to a last light-emitting element array, and the first node is a connection point of any two adjacent light-emitting element arrays among the serially connected light-emitting element arrays, wherein the controller includes:

an input voltage sensing unit configured to sense the level of the rectified signal and provide a sensing voltage according to a result of sensing;

a control circuit configured to compare the sensing voltage with the reference voltage, generate a first control signal according to the result of comparison, and generate second control signals based on the level of the sensing voltage;

a changeover switch unit configured to connect an end of the rectifier to the first node and perform a switching operation based on the first control signal; and a switching unit including a plurality of switches switched based on the second control signals, each of the switches being connected between an output terminal of any corresponding one among the serially connected light-emitting element arrays and the control circuit, and wherein the changeover switch unit includes:

a first changeover switch configured to connect the one end of the rectifier to the first node; and a second changeover switch configured to provide the first changeover switch with a gate control voltage, supplied from the control circuit, for controlling an operation of the first changeover switch, based on the first control signal.

2. The light-emitting element driving apparatus according to claim 1, wherein if the level of the rectified signal is less than the reference voltage, the controller connects at least one light-emitting element array belonging to the first group to at least one light-emitting element array belonging to the second group so as to be arranged in parallel, and if the level of the rectified signal exceeds the reference voltage, the controller connects the light-emitting element arrays belonging to the first group to the light-emitting element arrays belonging to the second group so as to be arranged in series.

3. The light-emitting element driving apparatus according to claim 1, wherein the changeover switch unit further includes:

a first resistor connected between a first drain and a first gate of the first changeover switch; and a second resistor connected between the first gate of the first changeover switch and the second changeover switch.

4. The light-emitting element driving apparatus according to claim 1, wherein the changeover switch unit further includes a Zener diode connected between a first source and the first gate of the first changeover switch.

5. The light-emitting element driving apparatus according to claim 1, wherein the changeover switch unit further includes a first diode connected between a cathode of a last light-emitting element array among the light-emitting element arrays of the first group and the first node.

6. The light-emitting element driving apparatus according to claim 1, further including a second diode connected between the first changeover switch and the first node.

7. The light-emitting element driving apparatus according to claim 1, wherein the controller further includes a protection unit including a first capacitor connected between a second node and the other end of the rectifier, and the second node is a node at which the last light-emitting element array of the serially connected light-emitting element arrays and a switch corresponding to the last light-emitting element array among the switches are connected.

8. The light-emitting element driving apparatus according to claim 7, wherein the protection unit further includes a second capacitor connected between a third node and the other end of the rectifier, and the third node is a node at which a light-emitting element array immediately prior to the last light-emitting element array and a switch corresponding to the light-emitting element array immediately prior to the last light-emitting element array are connected.

9. The light-emitting element driving apparatus according to claim 7, wherein the protection unit further includes a transistor having a source and a drain connected between the third node and the other end of the rectifier and a gate controlled by the control circuit.

10. The light-emitting element driving apparatus according to claim 1, wherein a number of the light-emitting element arrays of the first group is equal to a number of the light-emitting element arrays of the second group.

11. A light-emitting module, comprising:

a light-emitting unit including a plurality of serially connected light-emitting element arrays; and the light-emitting element driving apparatus according to claim 1.

12. The light-emitting element driving apparatus according to claim 1, wherein the first changeover switch comprises a first gate, and a first source and a first drain connected respectively to the end of the rectifier and the first node, and wherein the second changeover switch comprises a second gate to which the first control signal is applied, and a second source and a second drain connected respectively to the first gate of the first changeover switch and the control circuit.

13. The light-emitting element driving apparatus according to claim 1, wherein the input voltage sensing unit is configured to be a voltage distributor including a plurality of resistors.

14. The light-emitting element driving apparatus according to claim 1, wherein the first changeover switch is turned on in response to the first control signal so that the first group and the second group is connected in parallel, when the level of the rectified signal is less than the reference voltage.

15. The light-emitting element driving apparatus according to claim 1, wherein the first changeover switch is turned off in response to the first control signal so that the first group and the second group is connected in series, when the level of the rectified signal exceeds the reference voltage.

16. A light-emitting element driving apparatus for controlling a plurality of serially connected light-emitting element arrays, comprising:

a rectifier configured to rectify an alternating current (AC) signal and output a rectified signal;

an input voltage sensing unit configured to sense a level of the rectified signal and provide a sensing voltage according to the result of sensing;

a control circuit configured to generate a first control signal according to a result of comparing the sensing voltage with a reference voltage and generate second control signals based on a level of the sensing voltage;

a changeover switch unit configured to connect between an end of the rectifier and a first node and switched based on the first control signal; and a plurality of switches configured to perform a switching operation based on the second control signals, wherein each of the switches is connected to any corresponding one among output terminals of the serially connected light-emitting element arrays, wherein the first node is a connection point of any two adjacent light-emitting element arrays among the serially connected light-emitting element arrays, wherein the changeover switch unit includes:

a first changeover switch configured to connect the one end of the rectifier to the first node; and a second changeover switch configured to provide the first changeover switch with a gate control voltage, supplied from the control circuit, for controlling an operation of the first changeover switch, based on the first control signal, wherein the plural light-emitting element arrays include a first group including serially connected light-emitting element arrays starting from a first light-emitting element array to the first node and a second group including serially connected light-emitting element arrays starting from the first node to a last light-emitting element array, and wherein at least one of the light-emitting element arrays belonging to the first group is connected to at least one of the light-emitting element arrays belonging to the second group in series or in parallel by switching of the changeover switch unit and switching of the plural switches.

17. The light-emitting element driving apparatus according to claim 16, wherein the changeover switch unit electrically connects an end of the rectifier to the first node to form a current path between the end of the rectifier and the first node, when the level of the rectified signal is less than the reference voltage.

18. The light-emitting element driving apparatus according to claim 16, wherein the changeover switch unit electrically disconnects the end of the rectifier from the first node to cut off a current path between the end of the rectifier and the first node, when the level of the rectified signal exceeds the reference voltage.

19. The light-emitting element driving apparatus according to claim 16, wherein the reference voltage is equal to or greater than a sum of driving voltages of the light-emitting element arrays of the first group and a driving voltage of any one of the light-emitting element arrays of the second group.

20. The light-emitting element driving apparatus according to claim 16, wherein the first changeover switch comprises a first gate, and a first source and a first drain connected respectively to the end of the rectifier and the first node, and wherein the second changeover switch comprises a second gate to which the first control signal is applied, and a second source and a second drain connected respectively to the first gate of the first changeover switch and the control circuit.

* * * * *